United States Patent [19]

Hirai

[11] Patent Number: 5,018,489

[45] Date of Patent: May 28, 1991

[54] HEAT-INSULATING PISTON

[75] Inventor: Katsunori Hirai, Yamato, Japan

[73] Assignee: Isuzu Motors Limited, Tokyo, Japan

[21] Appl. No.: 571,359

[22] Filed: Aug. 23, 1990

[30] Foreign Application Priority Data

Sep. 13, 1989 [JP] Japan ..... 1-235639

[51] Int. Cl.[5] ..... F02F 3/00

[52] U.S. Cl. ..... 123/193 P; 92/212; 92/213

[58] Field of Search ..... 123/193 P; 92/176, 212, 92/213, 222, 223, 231

[56] References Cited

U.S. PATENT DOCUMENTS

| | | | |
|---|---|---|---|
| 4,552,057 | 11/1985 | Mizuhara | 92/212 |
| 4,592,268 | 6/1986 | Hartsock . | |
| 4,648,308 | 3/1987 | Matsui et al. | 92/231 |
| 4,735,128 | 5/1988 | Mahrus et al. | 92/213 |
| 4,838,149 | 6/1989 | Donnison et al. | 92/213 |
| 4,848,291 | 7/1989 | Kawamura et al. | 123/193 P |

FOREIGN PATENT DOCUMENTS

| | | |
|---|---|---|
| 0321159 | 6/1989 | European Pat. Off. . |
| 302164 | 12/1988 | Japan . |
| 1-108171 | 4/1989 | Japan . |

OTHER PUBLICATIONS

*Patent Abstracts of Japan,* (unexamined applications) M field, vol. 13, No. 133, 04/4/1989, The Patent Office Japanese Government, p. 132 M 809, Koaki-No. 63-302 125, Isuzu Motors, Ltd.

*Primary Examiner*—Andrew M. Dolinar
*Assistant Examiner*—M. Macy
*Attorney, Agent, or Firm*—Browdy and Neimark

[57] ABSTRACT

In a heat-insulating piston comprising a ceramic cylindrical member having the lower end surface thereof in contact with the outer peripheral upper end surface of a piston skirt member, a head base member having the peripheral portion thereof in contact with an inner peripheral step portion of the cylindrical member and fixed to the piston skirt member, a heat-insulating member disposed on the head base member and a ceramic thin film member disposed on the heat-insulating member and having the peripheral portion thereof bonded to the cylindrical member, this invention relates to a heat-insulating piston which inserts metallic heat-resistant members between the inner peripheral step portion of the cylindrical member and the peripheral portion of the head base member in order to prevent the occurrence of a gap between the thin film member and the heat-insulating member. To insert the metallic heat-resistant members between the inner peripheral step portion and the peripheral portion described above, the cylindrical member and the thin film member are first bonded and then the metallic heat-resistant members are softened and pushed into a groove defined between the inner peripheral step portion of the cylindrical member and the peripheral portion of the head base member, or pushed between the inner peripheral step portion of the cylindrical member and the peripheral portion of the head base portion.

14 Claims, 2 Drawing Sheets

HEAT-INSULATING PISTON

BACKGROUND OF THE INVENTION

1. Field of the Invention

This invention relates to a heat-insulating piston consisting of a composite structure containing a ceramic member and a heat-insulating member.

2. Description of the Prior Art

Conventionally, a heat-insulting piston is disclosed in Japanese Patent Laid-Open No. 302164/1988. This heat-insulating piston will be explained with reference to FIG. 6 of the accompanying drawings.

This heat-insulating piston comprises a piston head portion 41 having a fitting boss portion 44 at its center and made of a material having a thermal expansion coefficient substantially equal to that of a ceramic material, and a metallic piston skirt portion 42 having a center fitting hole 52 to which the fitting boss portion 44 is fitted at its center. The fitting boss portion 44 of the piston head portion 41 and the center fitting hole 52 of the piston skirt portion 42 are fixed to each other by metal flow of a metallic ring 51. A heat-insulating buffer material 48 as a heat-insulating gasket is interposed under a push state at the center contact portion between the piston head portion 41 and the piston skirt portion 42. A heat-insulating air layer 49 is defined between the piston head portion 41 and the piston skirt portion 42.

Furthermore, a ceramic thin sheet 45, which is formed to an extremely small thickness in order to reduce thermal capacity, is disposed on the piston head portion 41 through a heat-insulating material 43 in such a manner as to face a combustion chamber. A ceramic ring 46 made of the same material as the ceramic thin sheet 45 is fitted to the outer peripheral portion of the latter, and these ceramic thin sheet 45 and ceramic ring 46 are bonded at the contact portion by CVD (Chemical Vapor Deposition) as described in Japanese Patent Laid-Open No. 108171/1989 (U.S. Pat. No. 4,848,291), for example.

A step portion 56 is formed on the inner peripheral surface of the ceramic ring 46 and the outer peripheral portion of the piston head-portion 41 fits to the ceramic ring 46 so as to come into contact with the step portion 56 of the ceramic ring 46. A heat-insulating material 43 is sealed into the space defined by the ceramic thin sheet 45, the ceramic ring 46 and the piston head portion 41. This heat-insulating material 43 is made of a material such as potassium titanate whiskers, zirconia fibers. When the piston head portion 41 is fitted to the piston skirt portion 42 under the push state, the outer peripheral portion of the piston head portion 41 is pushed to the step portion 56 of the ceramic ring 46 and the ceramic ring 46 is pushed to the peripheral portion of the piston skirt portion 42. A carbon seal 47 as a gasket is interposed in order to provide sealing between the ceramic ring 46 and the piston skirt portion 42.

In a heat-insulating engine member using a ceramic material as a heat-insulating or heat-resistant material such as a piston, it is extremely difficult to obtain sufficient heat-insulating characteristics. The ceramic material is kept under the state where it is exposed to high temperatures on the combustion chamber side and there exist the problems, therefore, that the ceramic material receives a thermal shock and its strength is not sufficient. If the thickness of the ceramic material on the wall surface is increased for the purpose of heat insulation, a thermal capacity becomes greater and there occur the problems that intake air receives a greater quantity of heat from the combustion chamber and is heated to high temperatures during an intake stroke, its heat affects the intake air, suction efficiency drops and air cannot be sucked, whereas the heat-insulating property must be improved in an expansion stroke, on the contrary.

To solve these problems, the structure of the heat-insulating piston disclosed in Japanese Patent Laid-Open No. 302164/1988 is as described above in order to obtain extremely high heat-insulating property, to minimize the thermal capacity of the surface portion of the piston head which is exposed to the combustion gas and reaches high temperature, to improve intake efficiency and cycle efficiency, to eliminate the occurrence of the problems of strength even when a thermal shock is applied, to improve heat resistance, corrosion resistance and deformation resistance, to obtain a stable fitting state and to receive under a preferred state the pressure which acts on the piston head at the time of explosion. Further, it improves the seal function between the piston head and the piston skirt.

In the heat-insulating piston described above, the heat-insulating material disposed between the head base portion and the ceramic thin sheet disposed on the combustion chamber side is composed of whiskers or fibers of mullite, alumina, possium titanate, zirconia, or the like, and the ceramic thin sheet and the ceramic ring are made of a ceramic material such as silicon nitride. Therefore, since the materials are different between the heat-insulating material, the ceramic thin sheet around the former and the ceramic ring and their thermal expansion coefficients are therefore different, the difference of thermal expansion occurs between the different materials after the ceramic thin sheet and the ceramic ring are bonded mutually and a gap develops between the ceramic thin sheet as the surface of the piston head and the heat-insulating material. This is structurally disadvantageous to the explosion force at the time of combustion and results in the breakdown of the ceramic thin sheet.

Moreover, if the bond portion between the ceramic thin sheet and the ceramic ring is bonded by chemical vapor deposition or coating, the bond portion does not have the strength sufficient to keep the bonded state against the explosion force at the time of combustion, so that the bond portion between the ceramic thin sheet and the ceramic ring peels or cracks develops.

SUMMARY OF THE INVENTION

It is an object of the present invention to solve the problems described above and to provide a heat-insulating piston which provides a piston head portion with very high insulation property, constitutes a thin film member as the surface portion of a piston head which is exposed to a combustion gas, reaches a high temperature and faces a combustion chamber side by a ceramic material such as silicon nitride ($Si_3N_4$), silicon carbide (SiC), in order to secure heat-resistance of the thin film member, to minimize its thermal capacity, to improve follow-up property to the gas temperature and hence, suction efficiency, inserts particularly metallic heat-resistant members between a step portion of a cylindrical member constituting the slide surface and made of a ceramic material and the peripheral portion of a head base portion, pushes the heat-insulating member to the thin film member in order to prevent the occurrence of a gap between the thin film member and the heat-insulating member, to prevent the occurrence of a bending stress in the flat plate-like thin film member against the explosion force at the time of combustion, to prevent the breakage of the thin film member, to prevent the occurrence of peel and crack between the thin film member and the cylindrical member and improves strength.

In a heat-insulating piston comprising a cylindrical member whose lower end is brought into contact with the outer peripheral upper end surface of a piston skirt member, a head base member whose peripheral portion is brought into contact with the inner peripheral step portion of the cylindrical member and which is fixed to the piston skirt member, a heat-insulting member disposed on the head base member and a ceramic thin film member which is disposed on the heat-insulating member and whose peripheral portion is bonded to the cylindrical member, it is another object of the present invention to provide a heat-insulating piston characterrized in that metallic heat-resistant members are disposed in voids between the inner peripheral step portion of the cylindrical member and the peripheral portion of the head base member after the cylindrical member and the thin film member are bonded to each other.

It is still another object of the present invention to provide a heat-insulating piston wherein the void defined between the inner peripheral step portion of the cylindrical member and the peripheral portion of the head base portion consists of a groove formed in the inner peripheral step portion of the cylindrical member and a groove formed in the peripheral portion of the head base portion, the metallic heat-resistant members are softened and pushed into the grooves after the cylindrical member and the thin film member are bonded when inserting the metallic heat-resistant members into the voids, and moreover, the metallic heat-resistant members can be fitted into the groove easily and stably and can be fixed thereto rigidly.

It is still another object of the present invention to provide a heat-insulating piston wherein, in order to insert the metallic heat-resistant members into the voids between the inner peripheral step portion and the peripheral portion of the head base member, the metallic heat-resistant members are pushed into the voids after the cylindrical member and the thin film member are bonded, moreover the metallic heat-resistant members can be inserted into the voids reliably and sufficiently, and the fixed state of the metallic heat-resistant members can be stabilized and kept rigidly in place.

It is still another object of the present invention to provide a heat-insulating piston wherein, since the metallic heat-resistant members are disposed between the inner peripheral step portion of the cylindrical member and the peripheral portion of the head base member, the heat-insulating member can be brought into strong contact with the ceramic thin film member through the lower end surface of the cylindrical member and the outer peripheral upper end surface of the piston skirt member, that is, through the head base member, the close contact state between the peripheral portion of the head base portion and the heat-insulating member can be kept firmly, so that the close contact state between the thin film member as the surface exposed to the combustion gas and the heat-insulating member can be kept under a satisfactory state, no bending stress acts on the thin film member due to the explosion force, and high strength with high reliability can be secured.

It is a further object of the present invention to provide a heat-insulating piston which can secure a high heat-insulating property by the heat-insulating member, can minimize the thickness of the thin film member positioned on the surface portion of the piston head exposed to the combustion gas and reaching a high temperature, can minimize the thermal capacity of the thin film member, can improve suction efficiency and can obtain high heat-insulation, deformation resistance and corrosion resistance.

DESCRIPTION OF THE PREFERRED EMBODIMENT

Hereinafter, a preferred embodiment of the structure of a heat-insulating piston in accordance with the present invention will be described in detail with reference to the accompanying drawings.

Figure 1:
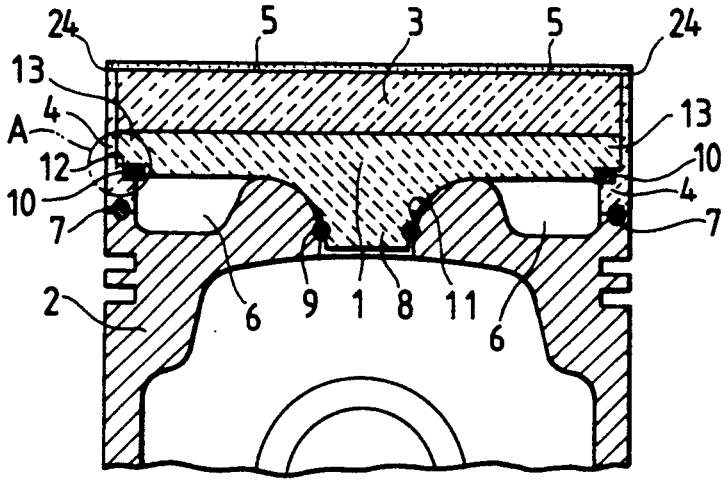
FIG. 1 is a sectional view showing a heat-insulating piston structure in accordance with one embodiment of the present invention.

FIG. 1 shows the structure of the heat-insulating piston in accordance with an embodiment of the present invention. This heat-insulating piston comprises primarily a piston skirt member 2, a cylindrical member 4 coming partially into contact with the piston skirt member 2, a head base member 1 fixed to the skirt member 2, a heat-insulating member 3 disposed on the head base member 1, a thin film member 5 disposed on the heat-insulating member 3 and bonded around its periphery to the cylindrical member 4, and metallic heat-resistant members 10 disposed in the spaces between the cylindrical member 4 and the head base member 1.

In this heat-insulating piston, the piston skirt member 2 is made of a metallic material. The cylindrical member 4 whose lower end surface is pushed to the upper end surface of the outer periphery of the piston skirt member 2 and the head base member 1 fixed to the piston skirt member 2 while its peripheral portion is pushed and brought into contact with an inner peripheral step portion 12 of the cylindrical member 4 are made of a ceramic material such as silicon nitride ($Si_3N_4$), silicon carbide (SiC). Further, the heat-insulating member 3 disposed on the head base is made of a whisker fired material of a ceramic material such as silicon nitride ($Si_3N_4$), Silicon carbide (SiC). The thin film member 5 which is disposed on the heat-insulating member 3 and whose peripheral portion is bonded to the cylindrical member 4 is made of a ceramic material such as silicon nitride ($Si_3N_4$) and silicon carbide (SiC). The metallic heat-resistant members 10 disposed between the inner peripheral step portion 12 of the cylindrical member 4 and the peripheral portion 13 of the head base member 1 are made of a heat-resistant alloy such as a nickel alloy.

A combustion chamber is not formed in this head base member 1 itself and the portion of the head base member 1 on the combustion chamber side is shaped flat. The head base member 1 and the piston skirt member 2 are fixed to each other by fitting the fitting boss portion 8 disposed at the center of the head base member 1 into the fitting hole 11 formed at the center of the piston skirt member 2 and disposing a metal ring 9 by metal flow into the groove portion defined between them. In this case, the inner peripheral step portion 12 is formed on the cylindrical member 4 constituting the upper portion of the slide surface of the piston, the peripheral portion 13 of the head base member 1 is engaged with this inner peripheral step portion 12 and moreover, the upper end surface of the outer periphery of the cylindrical member 4 and the lower end surface of the piston skirt member 2 are brought into pressure contact while interposing a seal member 7 between them. The heat-insulating member 3 is disposed in a cylindrical hole portion defined by the head base portion 1 and the cylindrical member 4. A heat-insulating air layer 6 is defined between the lower surface of the head base member 1 and the piston skirt member 2.

In this structure of the heat-insulating piston, the thin film member 5 disposed on the outer surface of the heat-insulating member 3 is made of the same ceramic material as the heat-insulating member 3 such as silicon nitride ($Si_3N_4$), silicon carbide (SiC), and can be disposed on the heat-insulating member 3 by bonding it to the side of the heat-insulating member 3 exposed to the combustion gas, that is, on its surface on the combustion chamber side, by CVD (Chemical Vapor Deposition) or coating. Accordingly, since this thin film member 5 provides the surface exposed to the combustion chamber and moreover, can be formed as thin as possible, the thermal capacity of the surface exposed to the combustion gas can be reduced and the structure can be made highly heat-resistant. This heat-insulating member 3 exhibits the heat-insulating function and at the same time, can function as a structural member which receive the pressure acting on the ceramic thin film member 5 at the time of explosion. In this structure of the heat-insulating piston, the compressive force due to explosion must be received uniformly by the heat-insulating member 3 and to this end, too, the upper surface of the head base member 1 and the thin film member 5 are shaped in a flat form.

Particularly in order to insert the metallic heat-resistant members 10 into the voids between the inner peripheral step portion 12 of the cylindrical member 4 and the peripheral portion 13 of the head base member 1, they are softened and pushed into the voids defined by the groove 15 formed in the inner peripheral step portion 12 of the cylindrical member 4 and the groove 14 formed in the peripheral portion 13 of the head base member 1 or pushed into the voids defined between the inner peripheral step portion 12 and the peripheral portion 13 of the head base member 1, as will be described later, after the cylindrical member 4 and the thin film member 5 are mutually bonded at the joint portion 24 of the peripheral portion but before the head base member 1 and the piston skirt member 2 are fixed to each other. When the metallic heat-resistant members 10 are inserted into the voids between the inner peripheral step portion 12 of the cylindrical member 4 and the peripheral portion 13 of the head base member 1, the heat-insulating member 3 can be brought into contact with the thin film member 5 through the head base member 1 and the occurrance of any gap between the thin film member 5 and the heat-insulating member 3 can be prevented.

Figure 2:
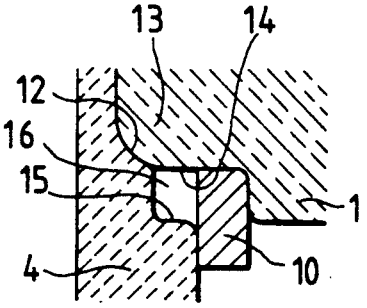
FIG. 2 is an enlarged view of the portion represented by symbol A in FIG. 1 before a heat-insulating member is inserted.
Figure 3:
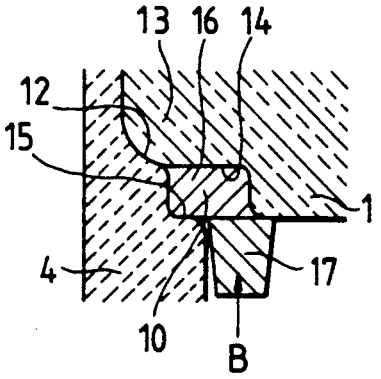
FIG. 3 is an enlarged view showing the state after insertion of FIG. 2.

In this structure of the heat-insulating piston, for example, the groove 15 is formed in the inner peripheral step portion 12 of the cylindrical member 4 and the groove 14 is formed in the peripheral portion 13 of the head base member 1 in such a manner as to define the voids of the metallic heat-resistant members 10, that is, their accommodation portion 16, as shown in FIG. 2. The metallic heat-resistant members 10 can be disposed in this accommodation portion 16 in the following way. As shown in FIG. 2, the metallic heat-resistant members 10 are first disposed at part of the accommodation portion 16 and then the heat-resistant metal is locally heated by a radio frequency heater and softened. Then, it is pushed completely into the accommodation portion 16 by use of a jig 17 as represented by arrow B in FIG. 3 and is thereafter hardened.

Figure 4:
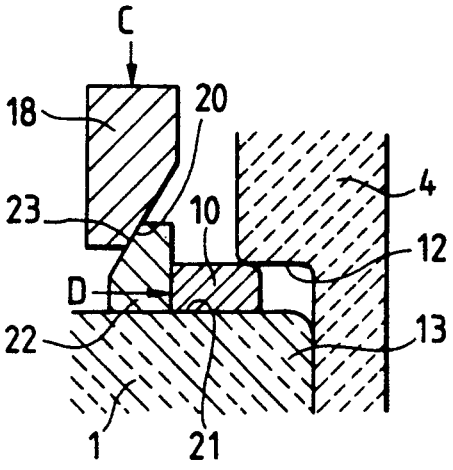
FIG. 4 is an enlarged view of the portion represented by symbol A in FIG. 1 and shows another example before insertion of the heat-insulating member.
Figure 5:
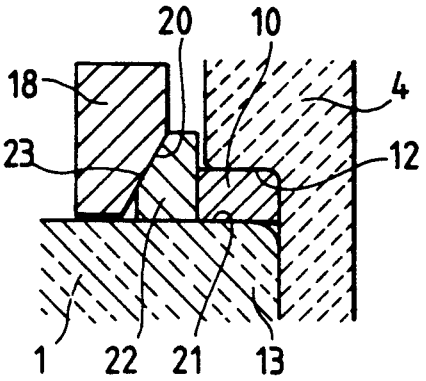
FIG. 5 is an enlarged view showing the state after insertion of FIG. 4.
Figure 6:
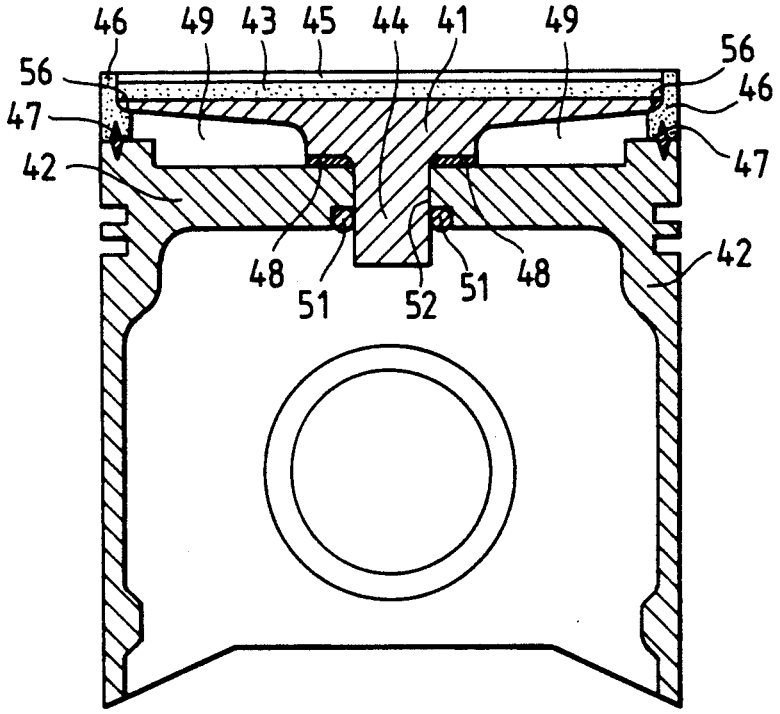
FIG. 6 (PRIOR ART)
FIG. 6 is a sectional view showing an example of the structure of a conventional heat-insulating piston.

Alternatively, the metallic heat-resistant members 10 can be disposed in the voids between the inner peripheral step portion 12 of the cylindrical member 4 and the peripheral portion 13 of the head base member 1 in the following way. The metallic heat-resistant members 10 are fabricated to the thickness of the void between the inner peripheral step portion 12 of the cylindrical member 4 and the peripheral portion 13 of the head base member 1 as shown in FIG. 4 and are placed on the lower surface 21 of the head base member 1. A push jig 22 having a taper surface 23 is put onto the side surface of the heat-resistant members 10. Then, another push jig 18 having a taper surface 20 which comes into sliding contact with the taper surface 23 of the push jig 22 is pushed in the direction represented by arrow C, so that the push jig 22 is moved in the direction represented by arrow D and can push the heat-resistant member 10 into the void between the inner peripheral step portion 12 of the cylindrical member 4 and the peripheral portion 13 of the head base member 1.

What is claimed is:

1. A heat-insulating piston comprising:

a piston skirt member having a peripheral upper end surface;

a ceramic cylindrical member having lower end surface thereof placed on said peripheral upper end surface of said piston skirt member to face the same;

said cylindrical member having a step portion extending inwardly in a radial direction, on the inner peripheral surface thereof;

a head base member fitted to said piston skirt member;

said head base member having the peripheral portion thereof kept in contact with said step portion of said cylindrical member;

a heat-insulating member disposed on the upper surface of said head base member; and a flat, ceramic thin film member disposed on the upper surface of said heat-insulating member and having the peripheral portion thereof bonded to the upper end portion of said cylindrical member;

wherein metallic heat-resistant members are inserted into voids defined between said inner peripheral step portion of said cylindrical member and said peripheral portion of said head base member in order to prevent the occurrence of any gap between the lower surface of said thin film member and the upper surface of said heat-insulating member.

2. A heat-insulating piston according to claim 1, wherein said void defined between said inner peripheral step portion of said cylindrical member and said peripheral portion of said head base member consists of a groove formed in said inner peripheral step portion of said cylindrical member and a groove formed in said peripheral portion of said head base member, and said metallic heat-resistant members are softened and pushed into said grooves.

3. A heat-insulating piston according to claim 2, wherein said heat-resistant members are softened by heating locally only said heat-resistant members in order to soften and push said heat-resistant members into said grooves, and said softened heat-resistant members are then pushed into said grooves.

4. A heat-insulating piston according to claim 1, wherein said metallic heat-resistant members are pushed into said void defined between said inner peripheral step portion of said cylindrical member and said peripheral portion of said head base member.

5. A heat-insulating piston according to claim 1, wherein said heat-resistant members are made of a heat-resistant alloy.

6. A heat-insulting piston according to claim 1, wherein said heat-resistant members are made of a nickel alloy.

7. A heat-insulting piston according to claim 1, wherein the upper end portion of said cylindrical member and the peripheral portion of said thin film member are mutually bonded by chemical vapor deposition.

8. A heat-insulating piston according to claim 1, wherein said ceramic thin film member is composed of a sheet-like member whose entire surface is flat.

9. A heat-insulating piston according to claim 1, wherein said thin film member is made of silicon nitride.

10. A heat-insulating piston according to claim 1, wherein said thin film member is made of silicon carbide.

11. A heat-insulating piston according to claim 1, wherein said heat-insulating member is made of mullite fibers.

12. A heat-insulating piston according to claim 1, wherein said heat-insulating member is made of a whisker fired material of a ceramic material.

13. A heat-insulating piston according to claim 1, wherein the upper surface of said head base member consists of a flat surface as a whole.

14. A heat-insulating piston according to claim 1, wherein both the upper and lower surfaces of said heat-insulating member consist of flat surfaces as a whole.

* * * * *